US005104009A

United States Patent [19]

Battegazzore

[11] Patent Number: 5,104,009

[45] Date of Patent: Apr. 14, 1992

[54] DISPENSER OF PASTE PRODUCTS WITH REFILL-TYPE CONTAINER

[75] Inventor: Piero Battegazzore, Alessandria, Italy

[73] Assignee: Guala S.p.A., Alessandria, Italy

[21] Appl. No.: 619,231

[22] Filed: Nov. 28, 1990

[30] Foreign Application Priority Data

Jan. 12, 1990 [IT] Italy ..... 19050 A/90

[51] Int. Cl.[5] ..... B67D 5/40; G01F 11/00

[52] U.S. Cl. ..... 222/209; 222/327; 222/380; 222/387

[58] Field of Search ..... 222/207, 209, 214, 325, 222/326, 260, 321, 314, 327, 380, 387

[56] References Cited

U.S. PATENT DOCUMENTS 3,088,636 5/1963 Spatz ..... 222/213
4,796,786 1/1989 Czech ..... 222/327
4,805,809 2/1989 Harris ..... 222/260
4,821,926 4/1989 Battegazzore ..... 222/209
4,830,228 5/1989 Fillmore ..... 222/260 X
4,946,076 8/1990 Hackmann et al. ..... 222/207

*Primary Examiner*—Donald T. Hajec
*Attorney, Agent, or Firm*—Notaro & Michalos

[57] ABSTRACT

A dispenser for paste products comprises a container and a hollow dispensing head having a pumping member mounted on its interior, an actuating lever for the member, and a delivery conduit which is associated at one end with the pumping member. The head has a tubular extension facing the top end of the container, which matches the contour of the container. The extension is releasably attached to the container, thereby the latter can be provided in the form of a replaceable refill container. To extend the working life of the dispensing head, the pumping member has a leaf spring associated therewith which acts against the push force from the actuating lever.

1 Claim, 3 Drawing Sheets

DISPENSER OF PASTE PRODUCTS WITH REFILL-TYPE CONTAINER

This invention relates to a dispenser of paste products, particularly but not exclusively of toothpaste, being of a type which comprises a tubular container having a vertical lengthwise axis, a hollow dispensing head located on the top end of the container, a bottom wall slidably movable inside the container in tight relationship therewith in one direction toward the head, a pumping member placed near the top end of the container, a sleeve having one end free and the opposite end associated with the pumping member, and an actuating lever for pressing the pumping members. The lever is mounted on the head and is movable angularly from a home position to a product dispensing position. There is also a delivery conduit having an inlet port and an outlet port and being mounted rigidly in the head. The actuating lever is provided with a cam profile for engagement with said free end of the sleeve, said delivery conduit being axially slidably connected to said sleeve through its inlet end. The pumping member comprises a flexible annular membrane with a radially outward edge and an inward edge, the latter edge being connected to said sleeve.

A dispenser of the above-outlined type is shown in European laid-open Patent Application No. 286,608, for example.

As may be seen, the dispenser known from that European Application provides for the tubular body of the container of paste product to be dispensed to also define, in its upper portion, a housing for the operational members, specifically for the pumping member, the delivery conduit, and the actuating lever.

It will be appreciated, accordingly, that once the container has been emptied, the dispenser can no longer be re-used, and must be disposed of. In this way, however, a dispenser portion is also thrown away unavoidably which is technologically more intensive, such as the dispensing head together with its components and mechanisms.

SUMMARY OF THE INVENTION

It is an object of this invention to provide a dispenser which allows its dispensing head to be re-used for a given number of times, by replacing the empty container with a fresh one.

This object is achieved by providing a dispenser having the elements of the claims annexed to and forming a part of this application.

To provide for an extended working life of the pumping member, as well as for the possible use of non-elastomer materials in its construction, a preferred embodiment of the dispenser of this invention is further characterized in that the head includes an elastic bias means acting on said pumping member against the push force from said actuating lever.

BRIEF DESCRIPTION OF THE DRAWINGS

The invention will now be described in greater detail with reference to a preferred, non-limitative embodiment thereof, shown in the accompanying drawings, where.

DESCRIPTION OF THE PREFERRED EMBODIMENT

Figure 1:
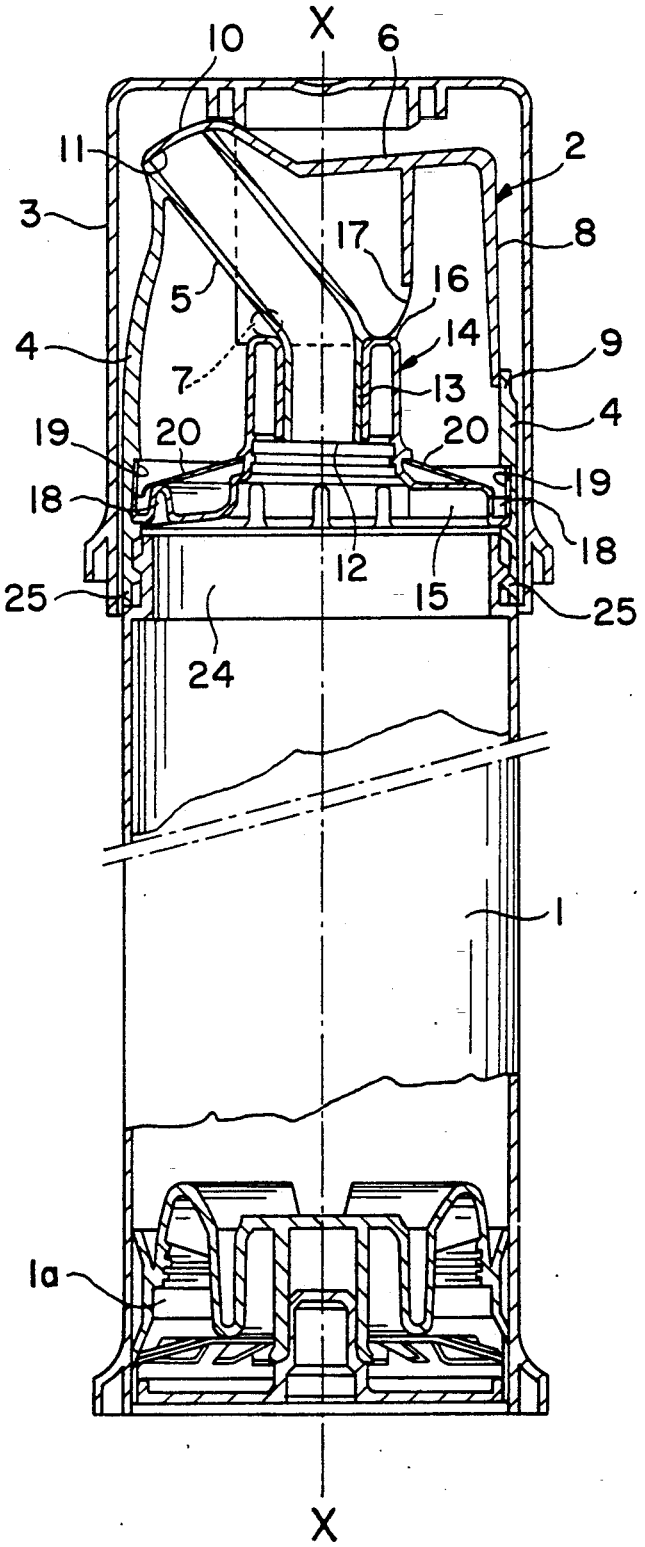
FIG. 1 is a partly cut away view of a dispenser according to the invention.

With reference to the drawing views, generally shown at 1 is the tubular container of a dispenser according to the invention which is provided with a bottom wall 1*a* conventionally adapted to be moved upwards through the container as the paste product is being dispensed. Generally indicated at 2 is the dispensing head of hollow construction. This head comprises a removable protective cap 3 which fits over a structure 4 whereto the delivery conduit 5 is attached. An actuating lever 6 is linked to said structure 4 by means of a pivot pin 7 such that it can perform angular movements about said pin which will take its shank 8 away from the edge 9 of the structure 4.

The lever 6 is also provided with a lip 10 which, with the lever at its home or rest position as shown in FIG. 1, covers the outlet port 11 of the delivery conduit 5 having, at its opposite end, an inlet port 12 on a conduit section 13 which extends along the longitudinal axis X—X of the head and the whole dispenser.

This section 13 of the delivery conduit 5 engages, for axial sliding movement, with the sleeve 14 associated at a central location with the pumping member consisting of a flexible annular membrane 15. The sleeve 14 has a free end 16 intended for co-operation with a cam surface 17 fast with the lever 6, to operate the pumping member in the manner disclosed, for example, in the aforementioned European Patent Application.

In accordance with this invention, the radially outward, peripheral edge 18 of the membrane 15 is held by the inner wall of the head structure 4, where it engages in an annular groove 19 effective to inhibit any axial movement thereof.

Associated with the membrane 15 is in accordance with a preferred aspect of the invention, a leaf spring 20.

Figure 2:
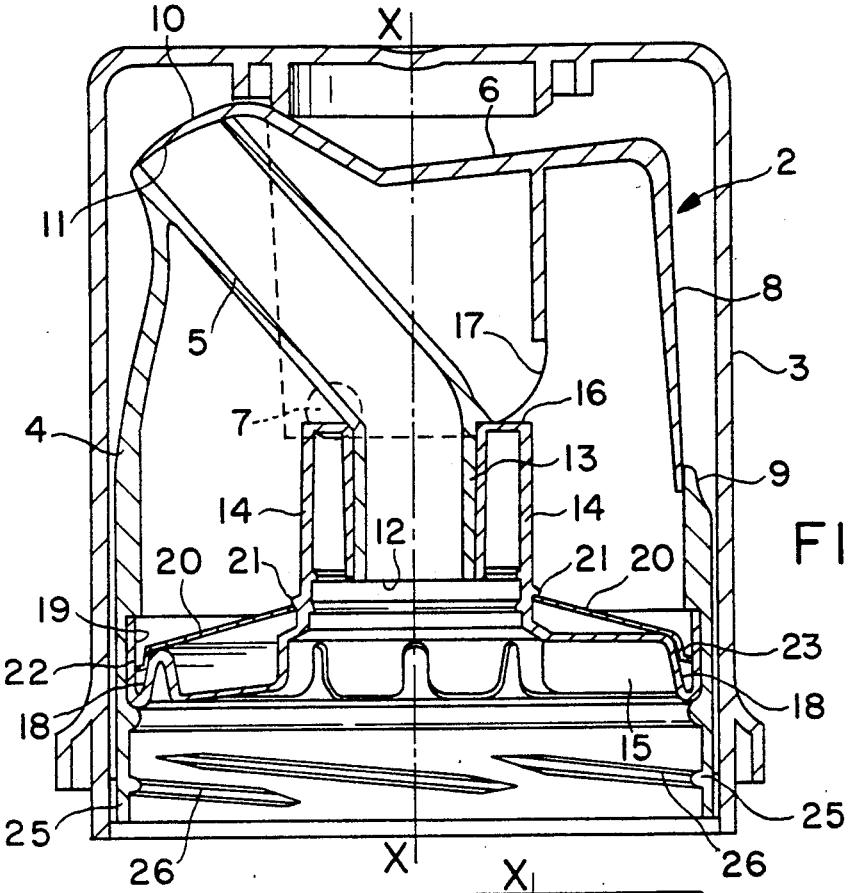
FIG. 2 shows, in axial section and to an enlarged scale, the dispensing head.
Figure 3:
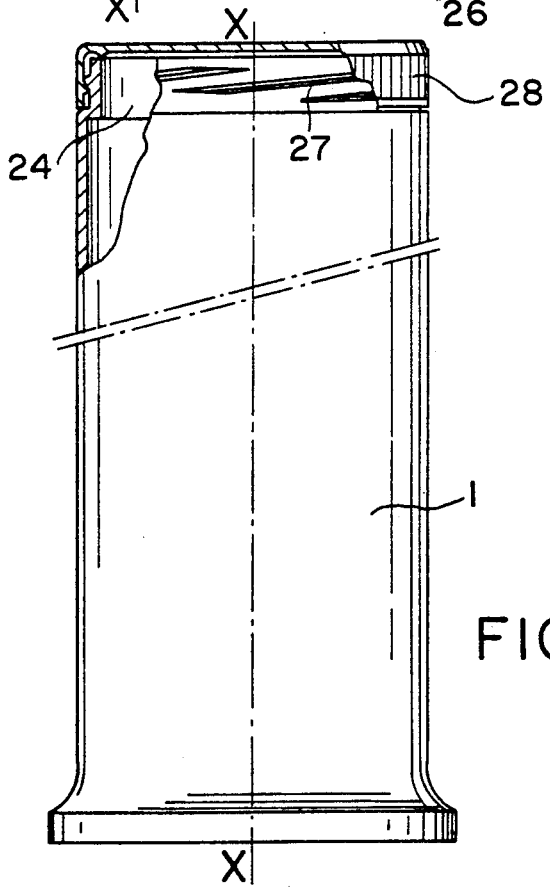
FIG. 3 is a partly cut away side view of a container in its form as a refill container.
Figure 5:
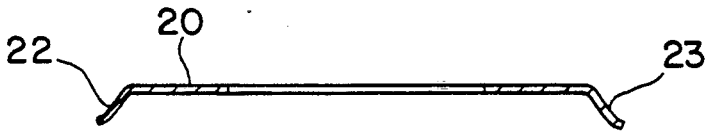
FIG. 5 is a sectional view of the leaf spring taken along V—V in FIG. 4.
Figure 4:
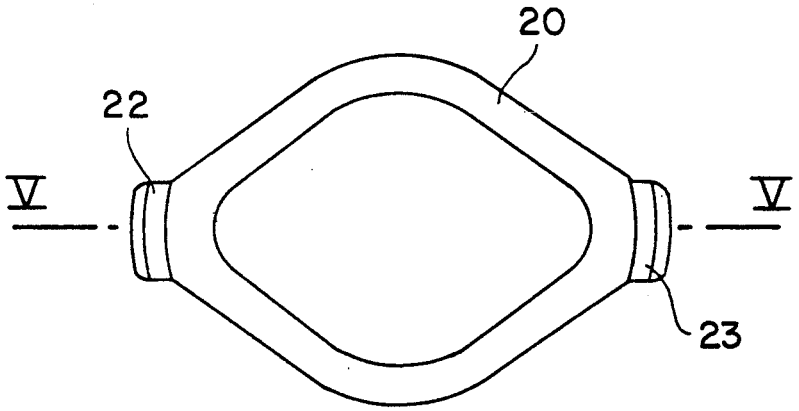
FIG. 4 is a plan view of a leaf spring for the pumping member.

With reference in particular to FIGS. 2, 4 and 5, this leaf spring is ring-shaped so as to encircle the sleeve 14, whereon it engages against a peripheral ridge 21. The opposed terminating portions 22 and 23 engage against the inner wall of the structure 4 in the groove 19, for the necessary reaction.

The dispensing head portion facing the top end 24 of the container 1 has a tubular extension 25 formed with a threadway 24 on its inside. This extension 25 duplicates the peripheral contour of the top end 24 of the container 1, which end is provided with a mating threadway 27.

The mutual engagement of the threadways 26 and 27 provides a releasable connection between the dispensing head 2 and the container 1.

The mating threadway 27 is, in particular, used for attaching a cover 28 which imparts, to the container 1 prior to its use in combination with the head 2, the appearance and function of a refill container.

The advantages and merits of a dispenser according to this invention should be apparent from the foregoing description and illustration of its operation.

After the amount of the product supplied in the container on first purchase of a complete dispenser has been depleted, the user may separate the container 1 from the head 2 and replace it with a fresh container while saving the head itself, which evidently constitutes the most expensive portion of such a dispenser unit, with obvious benefits from the economic standpoint.

The leaf spring 20 is contributive toward an extended working life of the head, and where a non-elastomer material is used in the construction of the membrane 15, also to provide the required elastic bias for the membrane.

I claim:

1. A paste product dispensing hollow head comprising:

a pumping member;

a sleeve having one end free and an opposite end connected to the pumping member;

an actuating lever for pressing the pumping member, said lever being mounted on said head and movable from a home position to a product dispensing position;

a delivery conduit having an inlet port and an outlet port and being mounted rigidly in the head, said actuating lever being provided with a cam profile for engagement with said free end of the sleeve, said delivery conduit being axially slidably connected to said sleeve through its inlet end;

said pumping member comprising a flexible annular membrane with a radially outward edge and an inward edge, the inward edge being connected to said sleeve;

a tubular extension adjacent said radially outward edge of the annular membrane;

connecting means on an inner wall of said tubular extension for connecting said hollow dispensing head to a container of paste product;

said radially outward edge of the flexible annular membrane being held axially fixed within said hollow head at a location close to said tubular extension; and a leaf spring encircling, at an intermediate point, said sleeve, said leaf spring having opposed free ends engaged with an inner wall of said hollow dispensing head.

* * * * *